United States Patent [19]

Skobel

[11] 4,408,375

[45] Oct. 11, 1983

[54] RELEASABLE CONNECTOR

[76] Inventor: Max Skobel, 10 Lynwood Rd., Edison, N.J. 08817

[21] Appl. No.: 303,790

[22] Filed: Sep. 21, 1981

[51] Int. Cl.[3] ..... A47G 29/10; A44B 11/25; A44B 15/00

[52] U.S. Cl. ..... 24/230 R; 70/459

[58] Field of Search ..... 24/213 B, 214, 230 R, 24/230 AS; 70/459

[56] References Cited

U.S. PATENT DOCUMENTS

| | | | |
|---|---|---|---|
| 2,099,655 | 11/1937 | MacFadden | 24/213 B X |
| 3,600,917 | 8/1971 | Krock | 24/230 R X |
| 3,967,351 | 7/1976 | Rosenberg et al. | 24/230 R |
| 3,979,934 | 9/1976 | Isenmann | 24/230 R X |
| 4,150,464 | 4/1979 | Tracy | 24/230 R X |

*Primary Examiner*—Robert P. Swiatek
*Attorney, Agent, or Firm*—Goodman & Teitelbaum

[57] ABSTRACT

A releasable connector having a receiving member and an insert member. The receiving member includes an elongated internal passageway which extends from one end of the receiving member. A pair of diametrically opposing retaining slots are spacedly positioned along the passageway. The insert member includes a pair of bifurcated springy legs which can be inserted into the passageway upon compression of the legs together. An outwardly extending foot at the distal end of each leg releasably locks into a respective one of the retaining slots. Cam surfaces are formed at the outer periphery of the feet to facilitate entry and exit of the insert member into and out of the receiving member.

4 Claims, 7 Drawing Figures

RELEASABLE CONNECTOR

BACKGROUND OF THE INVENTION

This invention relates to connecting devices, and more particularly to a connector having a quick assembly and release.

Connecting devices find many used in different fields of art. For example, a key chain typically may have separable parts with a key or a chain connected to each of the parts and wherein the parts are releasably interconnected. In this manner, one part can have the keys to a home, while the other part can have keys to a car; or one part can retain the ignition key while the other part can retain the trunk key. By having the two parts separable, it is possible to utilize one key while removing the second key for separate use.

A connecting device can also be used with jewelry, wherein a chain would have each of its ends connected to the separable parts of the connector and the connector is effectively used as a jewelry clasp.

Connectors also find use in tying together the ends of a cord or rope, holding together the ends of sealing tape, and numerous other uses.

In all of these situations, it is necessary to provide that the separable parts of the connector can be easily assembled without much difficulty, and can also be easily separated without complex procedures. At the same time, the two parts should be retained securely interconnected to each other during usage.

SUMMARY OF THE INVENTION

Accordingly, it is an object of the present invention to provide a releasable connector which can be used for interconnecting two items.

Another object of the present invention is to provide a releasable connector which can be easily interconnected and easily separated.

A further object of the present invention is to provide a releasable connector which can be easily assembled and separated, and which provides for secure retention of the parts together in their assembled condition.

Still another object of the present invention is to provide a releasable connector which is reduced in cost, easy to manufacture, simple to operate, and is readily usable.

Briefly, in accordance with the present invention, there is provided a releasable connector including a receiving member and an elongated insert member. The receiving member includes an elongated internal passageway extending from one end of the receiving member. A pair of diametrically opposed retaining slots are spacedly positioned along the passageway. The insert member includes a pair of bifurcated springy legs which are insertable into the passageway upon compression of the legs together. An outwardly extending foot is formed at the distal end of each leg for releasably locking into a respective one of the retaining slots. In this manner, with the feet locked into the slots, the legs spread apart and the insert member is securely retained within the receiving member.

In an embodiment of the invention, each foot has a number of cam surfaces along its periphery to facilitate the assembly and release of the two members. Specifically a forward cam surface on each foot engages the mouth of the passageway to direct the legs together in order to facilitate entry into the receiving member. Rearward of the forward cam surface is an arcuate cam which rides along the inner walls of the passageway to facilitate movement of the insert member through the passageway. A rearward cam surface engages an edge of the retaining slot to facilitate entry of the feet into the retaining slot as well as facilitating exit of the feet from the retaining slots.

BREIF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DETAILED DESCRIPTION OF THE PREFERRED EMBODIMENT

Figure 1:
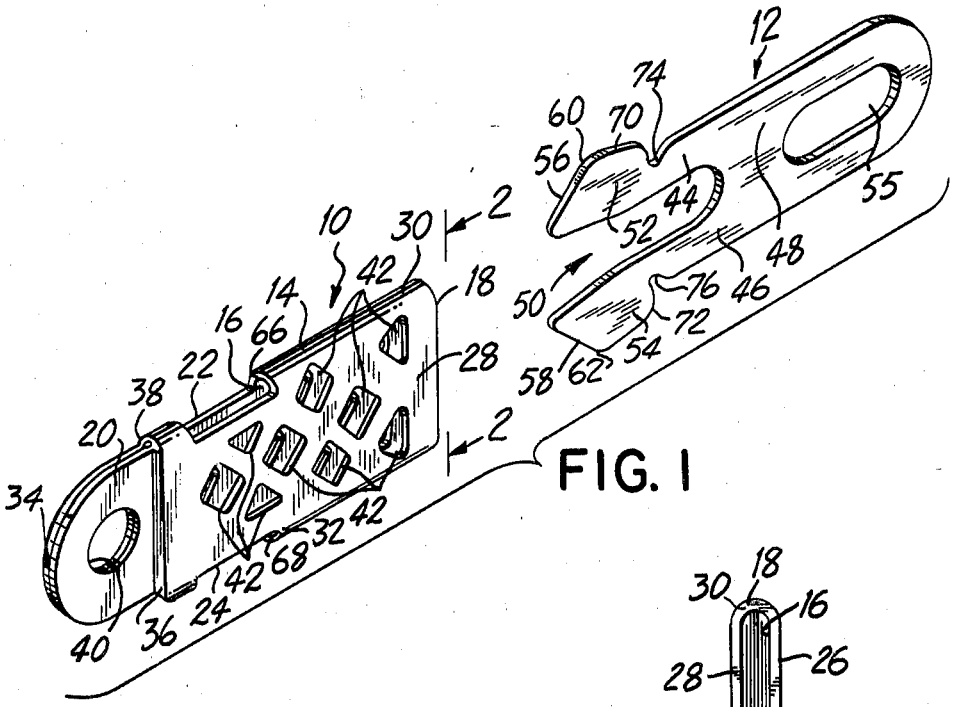
FIG. 1 is a perspective view of the releasable connector, and showing the receiving member and the insert member in a separated condition.
Figure 2:
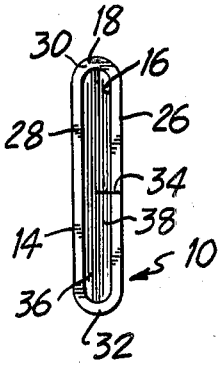
FIG. 2 is an edge view of the receiving member viewed along lines 2—2 of FIG. 1.

Referring now to FIGS. 1 and 2, the releasable connector is shown to include a receiving member, shown generally at 10, and an insert member, shown generally at 12. The recieving member 10 is shown to include a body section 14 in which is formed an elongated internal passageway 16 extending from a forward edge 18 of the body portion 14 at which the mouth of the passageway is provided. The rear of the passageway terminates in a tail portion 20. Spaced along the passageway, and substantially rearward of the mouth portion thereof, are formed an opposing pair of cutouts 22, 24 in the peripheral walls of the body portion 14, the cutouts communicating with the passageway 16 therein so as to define retaining slots.

The receiving member is shown to be formed of a single sheet of material which is folded over so as to define the opposing pair of walls 26, 28 interconnected at the upper and lower edges by arcuate narrow edge sections 30, 32. The sheet of material forming the receiving member is interconnected at approximately the mid-section of the wall 26 along the joining line 34. The edges of the material can be coupled by means of solder, or any other type of fastening arrangement. Alternately, if the material is strong enough, it can be retained without any fastening means.

The tail section 20 is formed by pressing together the material so as to define an internally extending ridge section 36, 38 at the junction between the body portion and the tail section 20. An aperture 40 is formed transversely through the two layers of material defining the tail section 20.

The receiving member is shown as a substantially flattened elongated shaped member. However, other shapes could similarly be provided. Since the receiving member may be formed of precious metal, especially when used as a jewelry clasp, there is provided openings 42 formed within the material so as to reduce the amount of material needed to form the receiving member. At the same time, the openings 42 can form a design to maintain the aesthetic beauty of the receiving member.

The insert member 12 includes a pair of bifurcated legs 44, 46 extending from a body portion 48 and separated by means of a slot 50 formed in the body portion so as to form the bifurcated legs. At the distal end of leg 44 is provided an outwardly extending foot portion 52 with a corresponding foot portion 54 outwardly extending from the leg 46. An elongated slot 55 is formed rearward of the legs and through the body portion 48.

The insert member 12 is formed substantially flat so as to be able to fit within the side walls 26, 28 defining the passageway 16 in the receiving member 10. In order to assemble the device, the insert member is inserted into the receiving member and pushed through the passageway until the legs 44, 46 engage and lock into the cutout openings 22, 24. In order to position the insert member into the receiving member, the two legs 44, 46 are compressed together. The legs then slide within the passageway 16 until the feet reach the cutout openings 22, 24, whereupon the two legs spread apart.

It should therefore be appreciated that the insert member is formed of springy material, such as steel, gold, plastic, or any such other material. The depth of the slot 50 will depend upon the resiliency of the springy material in order to provide sufficient compression of the two legs together so as to fit within the passageway.

Figure 3:
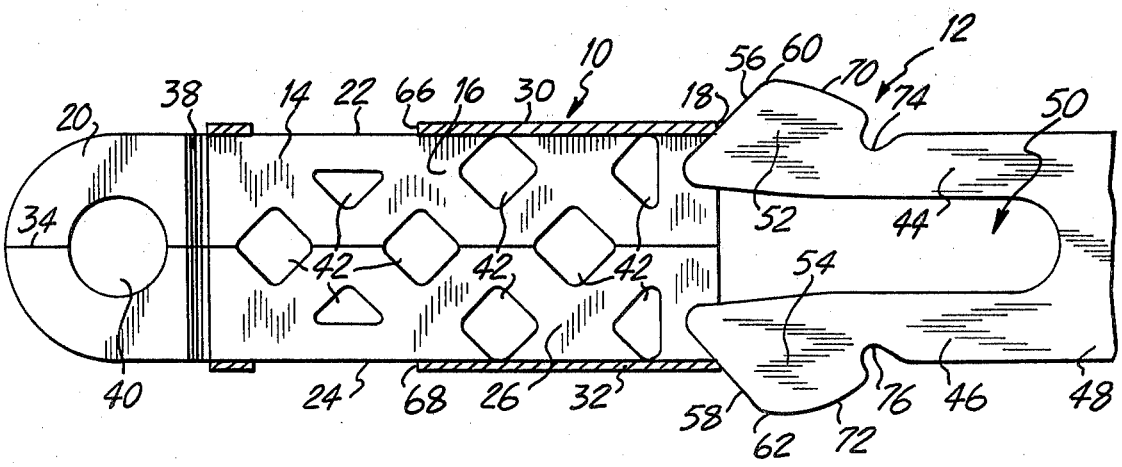
FIG. 3 is a cross sectional vertical view showing initial penetration of the elongated insert member into the receiving member.

In order to facilitate insertion and removal of the insert member, a number of cam surfaces are formed at the periphery of the feet 52, 54. Specifically, as shown in FIG. 3, a forward cam surface 56, 58 is respectively formed at the front end of the feet 52, 54. Such cam surfaces are outwardly flared, and rearwardly directed so as to engage the edge 18 of the receiving member, which defines the mouth of the passageway 16. As a force is applied pushing the insert member toward the receiving member, the cam surfaces 56, 58 engage the mouth of the passageway, and serve to direct the two legs 44, 46 toward each other so as to facilitate entry of the legs into the passageway 16.

Figure 4:
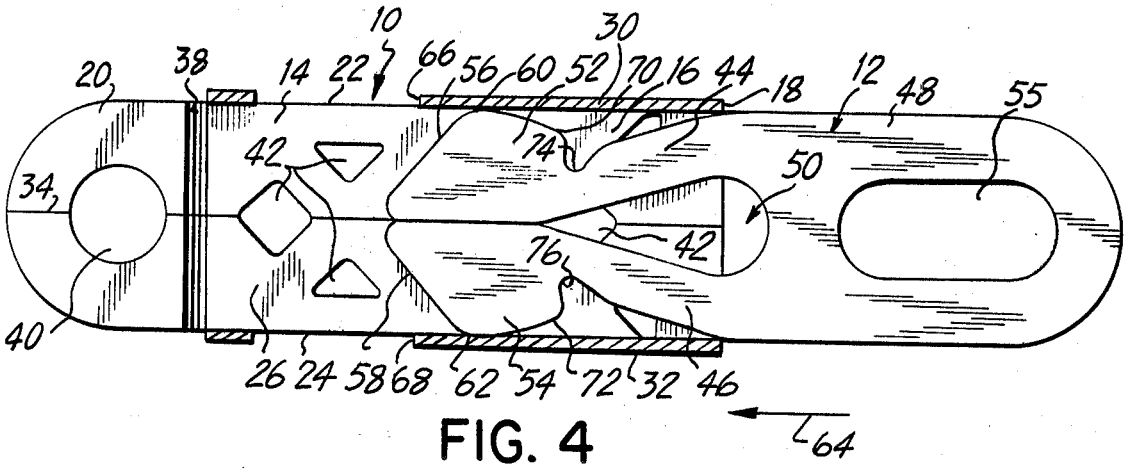
FIG. 4 is a view similar to that shown in FIG. 3, and showing progression of the insert member within the receiving member.
Figure 5:
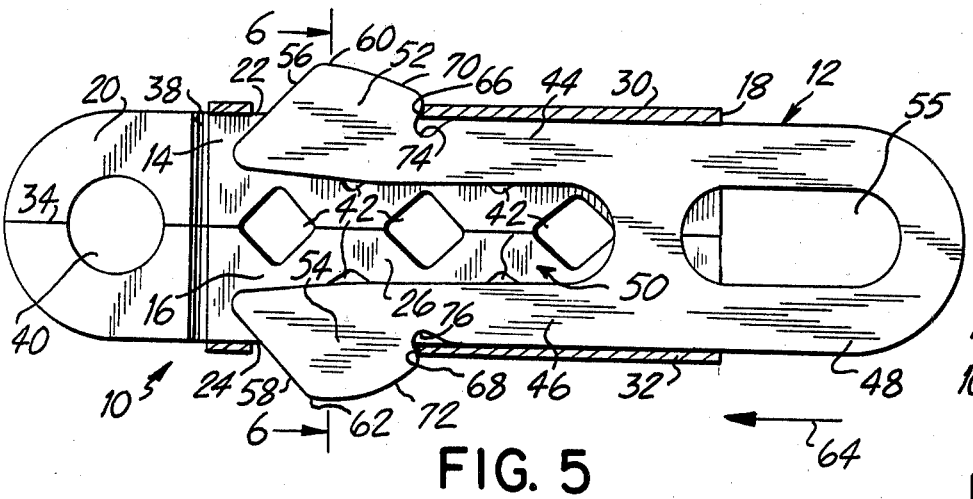
FIG. 5 is a view typical to that shown in FIGS. 3 and 4, and showing the insert member locked within the receiving member.
Figure 6:
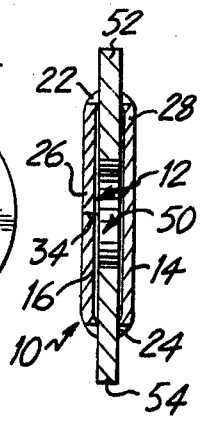
FIG. 6 is a cross sectional view taken along lines 6—6 of FIG. 5.

Once the legs have been brought together sufficiently to permit their entry into the passageway 16, as shown in FIG. 4, a further cam surface 60, 62 formed rearwardly of the forward cam surfaces 56, 58, facilitate passage of the insert member 12 through the passageway 16. The cam surfaces 60, 62 are arcuate in shape and ride along the edge walls 30, 32 of the passageway. In this manner, the insert member 12 can be easily moved through the receiving member, in the direction shown by the arrow 64.

The insert member 12 continues through the passageway until the feet 52, 54 engage the edge 66, 68 of the cutout openings 22, 24. At that point, the cam surfaces 70, 72, which are rearward of the cam surfaces 60, 62 facilitate spreading apart of the bifurcated legs 44, 46 and at the same time facilitate entry of the feet into their locking position within the cutout openings 22, 24. These rearward cam surfaces 70, 72, are inwardly curved and rearwardly directed from the arcuate cam surfaces 60, 62.

Rearward of the cam surfaces 70, 72, and at the junction between the feet 52, 54 and their receptive legs 44, 46, are provided the undercut sections or notches 74, 76. These undercut sections form locking shoulders against the edges 66, 68 of the cutout openings 22, 24. As the forward movement of the insert member 12 continues, and as the feet lock within the slots 22, 24, the undercuts retain the insert member locked in place in the receiving member and prevent its extraction by pulling in a direction opposing the arrow 64.

Figure 7:
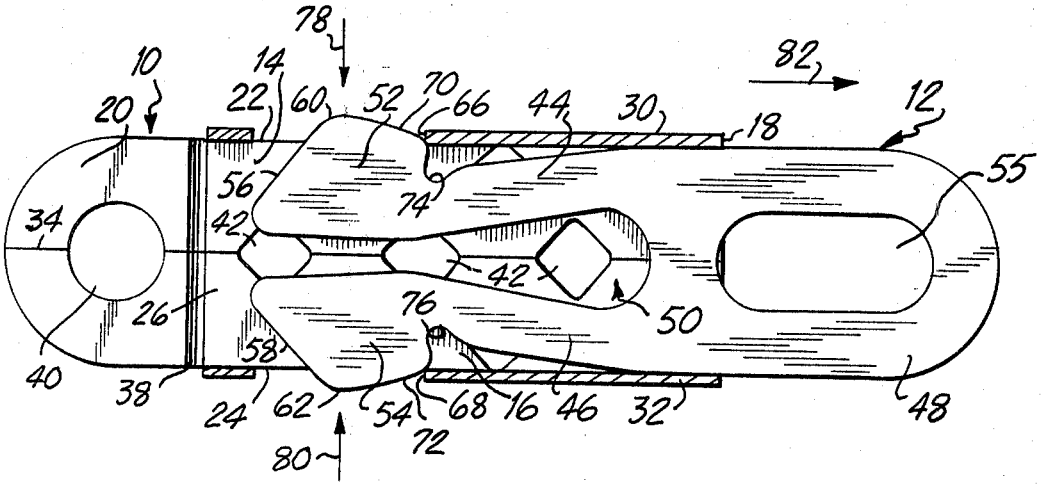
FIG. 7 is a view similar to that shown in FIGS. 3–5 and showing release of the insert member from the receiving member for separation of the two members from each other.

With the insert member securely retained in the receiving member, the feet will extend laterally outward through the cutout openings 22, 24. In order to release the insert member from the receiving member and thereby open the connector, pressure is provided onto the two feet 52, 54 in the direction shown by the arrows 78, 80 in FIG. 7. By pushing together the two feet sections 52, 54, the edges 66, 68 are released from the undercuts 74, 76 and the edges 66, 68 can again ride along the cam surfaces 70, 72 as the insert member is extracted by pulling in the direction shown by the arrow 82.

During extraction, the cam surfaces 60, 62 will again ride along the side walls 30, 32 as the insert member 12 is extracted.

Once the insert member is fully pulled out of the receiving member, the two legs will again separate and return to their original position as shown in FIG. 1.

The apertures 40, 55 formed at the opposing remote ends of the connector can be used for interconnecting various chains, cords, etc. For example, when used as a jewelry clasp, the apertures can be connected to opposing ends of a chain or bracelet. Similarly, key chains can be connected to each of the apertures so that each member on the connector holds a separate key. In this manner, while one key is being utilized the other key can be separated and brought to a different location.

For convenience, the slot 55 is shown as an elongated slot. However, it is appreciated that this aperture can be formed circular as is the aperture 40 at the other end of the connector.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A releasable connector comprising:

a receiving member having an elongated internal passageway extending from one end thereof, and a pair of diametrically opposing retaining solts spacedly positioned along said passageway, said retaining slots being openings extending through opposing longitudinal edges of said receiving member, said passageway including a mouth at said one end;

a substantially flat elongated insert member having a pair of bifurcated springy legs insertable into said passageway upon compression of said legs together into an abutting position, an outwardly extending foot at a distal end of each leg for releasably locking into a respective one of said retaining slots when said legs spread apart with each foot extending through its associated opening to securely retain said insert member in said receiving member in a locked position;

said insert member feet having a combined transverse width in said abutting position substantially equal to a transverse width of said receiving member passageway to limit said compression of said legs and to provide alignment between said legs and said passageway during insertion of said legs through said passageway;

an outwardly flaring, rearwardly directed first cam surface at a forward end of each foot for engaging said mouth of said passageway to direct said legs together into said abutting position to facilitate entry of said insert member into said passageway;

an arcuate second cam surface on each foot rearward of said forward first cam surface for riding along inner edge walls of said passageway to facilitate passage of said insert member through said passageway;

an inwardly curved, rearwardly directed rear third cam surface on each foot being rearward of said arcuate second cam surface for engaging an edge of a respective retaining slot to facilitate entry of said feet into said retaining slots and to also facilitate exit of said feet from said retaining slots;

a notched junction between each foot and its respective leg, each notched junction having an inwardly directed edge rearward of its associated rear third cam surface, each notched junction edge being disposed in substantially the same direction as its associated first cam surface so that an acute angle is formed between the longitudinal axis of the junction and the insert member longitudinal axis to provide a hook-like portion on its associated foot for locking onto said edge of said respective retaining slot; and each notched junction including an undercut portion extending inwardly from its notched junction edge to insure that said notched junction edge engages against said edge of said respective retaining slot in said locked position.

2. A releasable connector as in claim 1, wherein said receiving member is fabricated from a single sheet of material folded over to provide said passageway.

3. A releasable connector as in claim 2, wherein said receiving member comprises a flattened section at the opposite end thereof for facilitating connection of articles to said receiving member.

4. A releasable connector as in claim 1, and further comprising apertures provided at the remote ends of each of said members for coupling articles to said members.

* * * * *